US005912653A

United States Patent [19]

Fitch

[11] Patent Number: 5,912,653

[45] Date of Patent: Jun. 15, 1999

[54] GARMENT WITH PROGRAMMABLE VIDEO DISPLAY UNIT

[76] Inventor: Stephan J. Fitch, 204 Warren St., Jersey City, N.J. 07302

[21] Appl. No.: 08/902,392

[22] Filed: Jul. 29, 1997

Related U.S. Application Data

[63] Continuation of application No. 08/306,839, Sep. 15, 1994, abandoned.

[51] Int. Cl.[6] ..... G09G 3/36

[52] U.S. Cl. ..... 345/87; 347/7; 362/103; 40/586

[58] Field of Search ..... 345/7, 8, 87, 9, 345/30, 55; 40/586, 541; 362/103, 108

[56] References Cited

U.S. PATENT DOCUMENTS

| | | | |
|---|---|---|---|
| 3,570,158 | 3/1971 | Hackett | 40/130 |
| 3,802,945 | 4/1974 | James | 40/28 R |
| 4,142,782 | 3/1979 | O'Brian | 40/448 |
| 4,196,976 | 4/1980 | Hoffman, III | 40/441 |
| 4,254,451 | 3/1981 | Cochran, Jr. | 362/103 |
| 4,423,734 | 1/1984 | Schawel | 40/586 |
| 4,500,880 | 2/1985 | Gomersall et al. | 340/825.35 |
| 4,584,603 | 4/1986 | Harrison | 455/3 |
| 4,601,120 | 7/1986 | Levin | 40/586 |
| 4,602,191 | 7/1986 | Davila | 315/76 |
| 4,636,866 | 1/1987 | Hattori | 345/8 |
| 4,709,307 | 11/1987 | Banom | 362/103 |
| 4,809,078 | 2/1989 | Yabe et al. | 350/345 |
| 4,823,240 | 4/1989 | Shenker | 362/103 |
| 4,839,638 | 6/1989 | Kosler et al. | 345/99 |
| 4,866,515 | 9/1989 | Tagawa et al. | 455/3 |
| 4,875,144 | 10/1989 | Wainwright | 362/103 |
| 4,886,010 | 12/1989 | Stutzman | 40/322 |
| 4,893,903 | 1/1990 | Thakar et al. | 40/575 |
| 4,932,147 | 6/1990 | David | 40/448 |
| 4,965,705 | 10/1990 | Lin | 362/103 |
| 4,980,679 | 12/1990 | Klaubert | 340/825.35 |
| 5,013,972 | 5/1991 | Malkieli et al. | 315/209 R |
| 5,081,687 | 1/1992 | Henley et al. | 382/8 |
| 5,088,806 | 2/1992 | McCartney et al. | 359/84 |
| 5,416,310 | 5/1995 | Little | 235/462 |
| 5,436,744 | 7/1995 | Arledge et al. | 359/82 |
| 5,456,000 | 10/1995 | Gozdz et al. | 29/623.2 |

*Primary Examiner*—Dennis-Doon Chow
*Attorney, Agent, or Firm*—Graham & James LLP

[57] ABSTRACT

A garment with a programmable microcontroller to control digital and analog video signals which are displayed on flexible flat panel color liquid crystal display (LCD), embedded into the garment. The LCD is locked onto the garment by means of a locking slide fastener and is programmable through use of the microcontroller unit. The microcontroller unit is used to control display of digitally recorded and analog video sequences. Images can also be programmed to display based on environmental conditions as well as other trigger methods. The garment comes with a built-in Global Positioning System (G.P.S.) for security against theft. Garments can navigate owner through programming of microcontroller through voice navigation for and can be initialized to respond to the owners voice-print. Garments come with peripheral input capability allowing input of such analog and digital devices as miniature cameras, computers, CD-ROMS, etc. . . . All signals can be set to a broadcast frequency allowing other receiving jackets operating on the same frequency to access and display the broadcasters images.

15 Claims, 4 Drawing Sheets

GARMENT WITH PROGRAMMABLE VIDEO DISPLAY UNIT

This application is a continuation of application Ser. No. 08/306,839, filed Sep. 15, 1994, now abandoned.

BACKGROUND OF INVENTION

The present invention relates generally to digital video computer networks, video games and garment accessories. Specifically it relates to the purposes of self-expression through emblems, patches, and paintings on garments and the use of video to express oneself, through the incorporation of electronics and computer technology in clothing.

The trends of fashion to some extent rely on the availability of technology as well as reactions to the current social milieu. The need to express oneself and to some extent separate oneself from others is understood as the driving force behind the fashion industry. For the first time, in this invention, it is possible to merge the electronic/digital industry with fashion through the incorporation of programmable digital video into garments.

SUMMARY OF THE INVENTION

It is therefore a primary object of the present invention to provide a garment with a programmable micro-controller, to orchestrate sequencing and the composition of digital video, computer graphics, audio and broadcast television signals which appear on high resolution color liquid crystal displays (LCD's) attached to garments. Using memory chips as the storage device for digital video and by implementing a lightweight flexible power source which is lined in the garment, moving video images are displayed on the LCD. These LCD displays can be placed like a patch anywhere on the garment. Images and effects can be programmed into the garment and recorded images displayed in a fashion preselected by the user through a built in software program which dictates the behavior of the microcontroller embedded in the garment which is attuned to environmental and/or sensory variables, such as temperature, humidity, sounds and touch. Connectivity is enabled through serial or parallel interfaces allowing interfacing to computers, CD-ROM's and video digitizers as well as other peripheral hardware. The invention called a VideoPatch is removable and upgradable. The VideoPatch has stereo and mono audio capabilities with volume control as well as a broadcast and/or headphone mode.

Another object is to provide a garment with programmable video through a microcontroller which can be easily fitted to or removed from to any existing garment.

Another object is to provide a garment, such as, for example, a jacket, with programmable video through the use of a microcontroller in which the flexibility of the garment is substantially retained. This is accomplished using a flexible, removable, rechargeable battery as a power source, a configuration of multiple tiled micro color LCD's for flexibility and a microcontroller requiring limited space.

Another object is to provide a garment, such as, for example, a jacket, with programmable video in which a microcontroller through a built-in software program controls the sequencing and composition of the displayed images, based on any number of preselected or environmental and/or sensory variables.

Another object is to provide a garment with programmable video in which the microcontroller can be programmed by several program storage means both internally and externally, including, but not limited to, read only memory, tape mediums, random access memories such as CD-ROMS and peripheral computers and limited broadcast frequencies.

Another object is to provide a garment with programmable video in which the microcontroller's software program can be accessed through a provided serial/parallel port to an external device such as a computer either locally over null modem cable or remotely over telephone lines. The microcontroller program can be uploaded, altered, simulated and downloaded back to the garment.

Another object is to provide a garment with programmable video in which audio can also be stored, or passed-through live, amplified and controlled through the microcontroller.

Another object is to provide a garment with programmable video in which the microcontroller can receive broadcast signals, including, but not limited to, TV, Radio and cellular phone frequencies. Signals can be amplified, captured and broadcast (forwarded) through the microcontroller to other frequencies.

Another object is to provide a garment with programmable video which is completely solid state (no mechanical components) and maintains digital storage for all video and audio signals for display.

Another object is to provide a garment with programmable video in which the microcontroller is used to sequence the display of video images, with user selectable sequencing patterns and variable length image sequences.

Another object is to provide a garment with programmable video in which the use of input sensors (sensing the environment the garment is in) can be used to alter parameters of the video display such as the video patterns being sequenced, contrast, and frame rate.

Another object is to provide a garment with programmable video in which the use of audible feedback can be enabled to help guide the user through the setup menus without actually having to see the video display.

Another object is to provide a garment with programmable video in which the use of a Global Positioning System (G.P.S.) beacon is embedded into the hardware. Information such as location of jacket can be used and broadcast to inform law enforcement as well as friends of the location of wearer when owner activates system.

BRIEF DESCRIPTION OF THE DRAWING

The figures in the drawing are briefly described as follows.

In the several FIGS. like elements bear like legends.

DETAILED DESCRIPTION OF THE PREFERRED EMBODIMENTS

Figure 1:
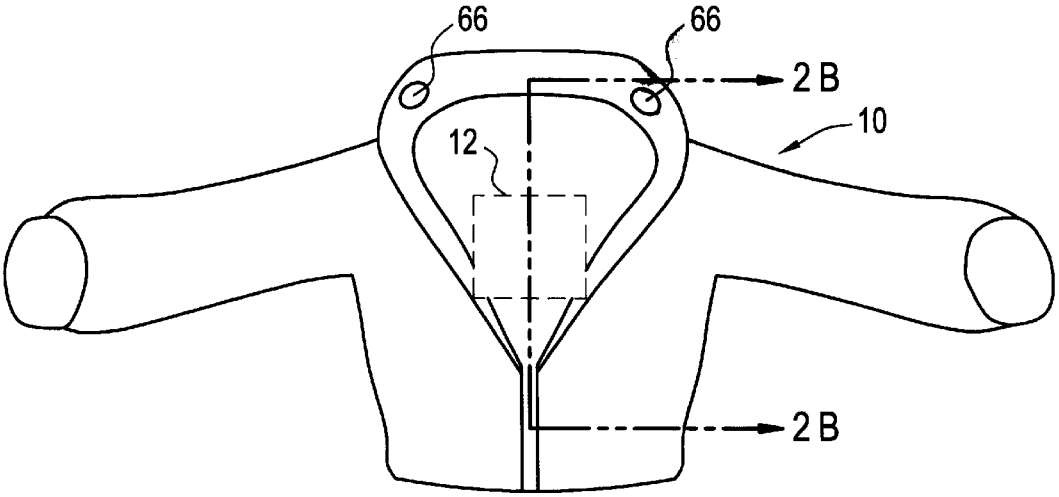
FIG. 1 is a front view of a jacket with the invention installed therein.

In FIG. 1 a garment such as a jacket 10 has no apparent electronics embodied therein. All electronics are stored within a lining of the jacket with the exception of a liquid crystal display 12 which protrudes from the back center of the jacket.

Figure 2A:
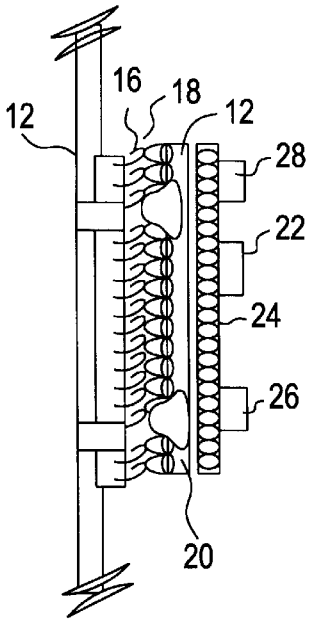
FIG. 2 is a side cross-sectional view exploded taken along line 2—2 on FIG. 1.
Figure 2B:
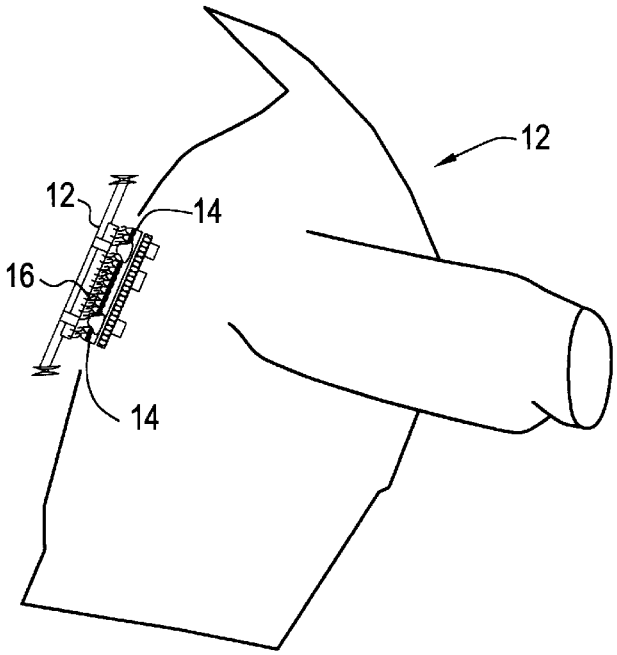

In FIG. 2 the jacket 10 is seen with the LCD display 12 installed in the mid center of the back of the jacket. The color liquid crystal display protrudes from one aperture 14 in the jacket and is fastened by a slide fastener lock configuration 16 18, or by any other convenient or conventional attachment. The slide lock fastener is sewn into the jacket and clamps the LCD display 12 in place. A second fastener 20 is bonded to an inner side of the jacket and clamps a microcontroller 22 and circuit board 24 to the jacket. Although, a single microcontroller 22 is illustrated, it is understood that any number of microcontrollers 22 and displays 12 may be used.

Figure 3:
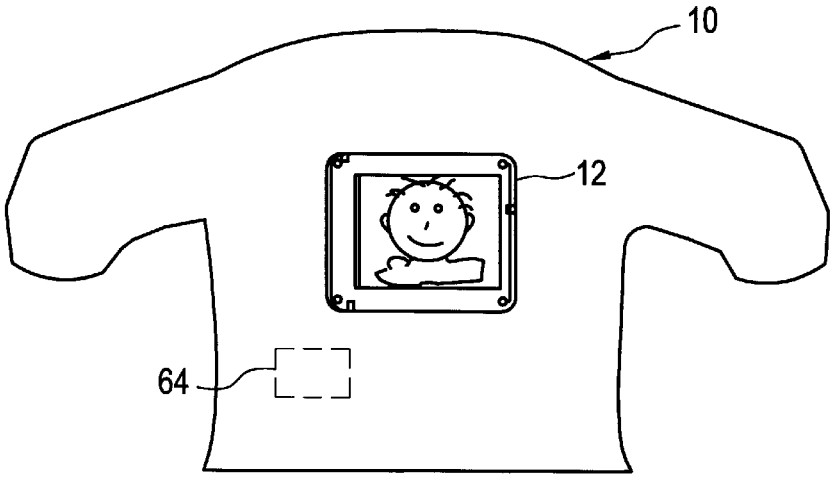
FIG. 3 is a back view of a jacket with the invention installed therein.

In FIG. 3 a configuration which reveals a television commercial is displayed in the liquid crystal display (LCD) 12. In this instance the moving image has been compressed externally using a digitizing board and stored on PAL memory chips located on the printed circuit board 24 on the garment. Reference should also be now made to FIG. 6 which shows a block diagram of part of the invention. Images are accessed by the microcontroller 22 which, depending on the specified programming, displays the commercial within the parameters given for that particular sequence. Input devices can be accessed directly by the microcontroller for programmed responses, including, but not limited to, the storage of video information into image memory 26. When digital images are required for playback the microcontroller unit accesses the image memory 26 or other specified storage device and retrieves the video file sending it through a image decoder 28 to a videoswitch 30 and to a LCD display driver 32 and then to the display 12.

The microcontroller 22 may access the video switch 30 directly, and select for display inputs from an analog video storage device 34. The microcontroller controls the switch 30 to select the input from these analog video storage devices 34.

The analog video storage devices 34 as shown as video tuner 36, a video recorder 38 or video camera 40. These three storage devices are optional accessories and are external to the jacket. They are connected to the video switch by input jacks shown schematically by the dotted arrows.

Figure 6:
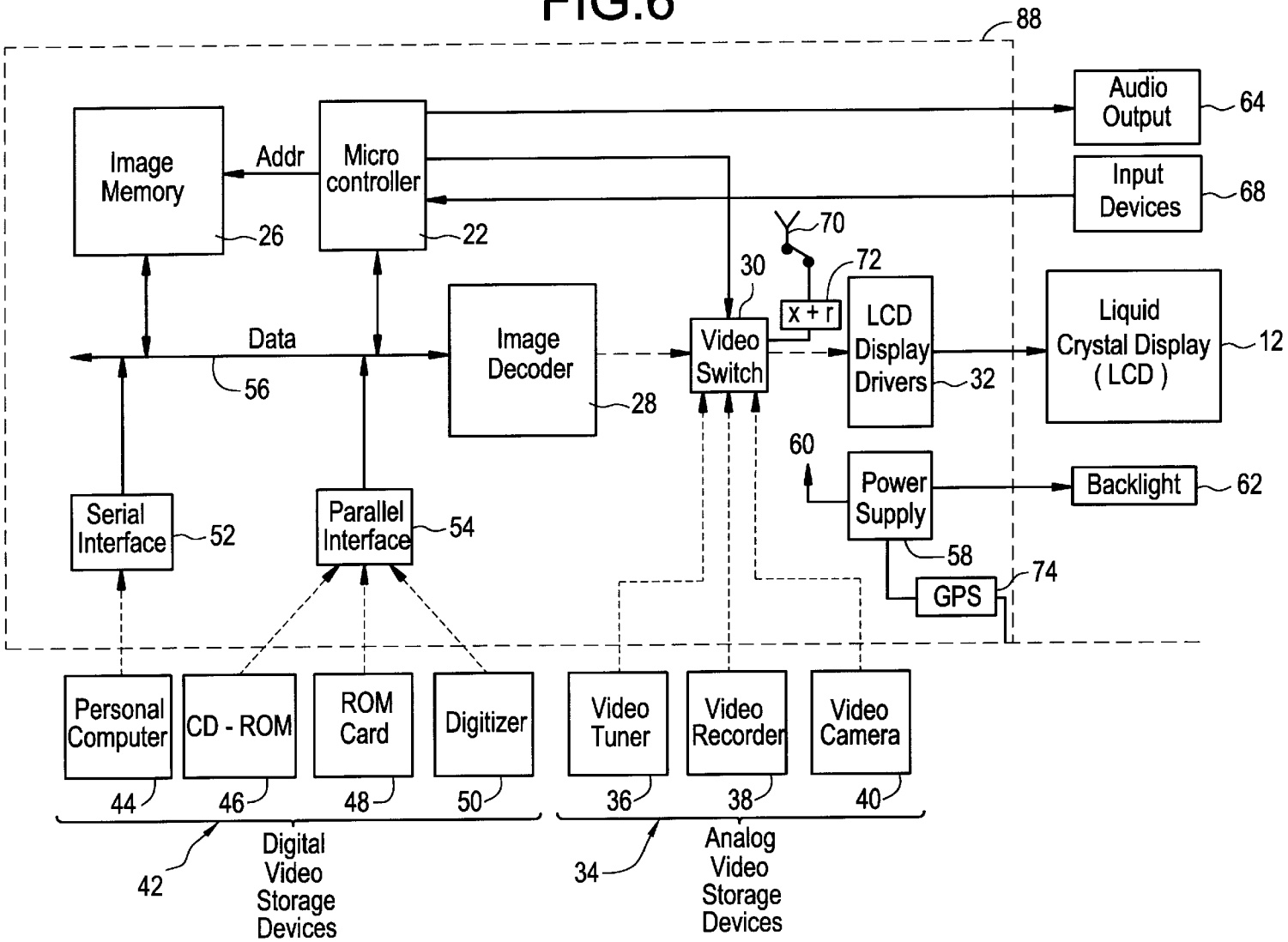
FIG. 6 is a block diagram of the circuit incorporated in one embodiment of the invention allowing display of preprogrammed digital video sequence.

In FIG. 6 the dotted horizontal line towards the bottom of the Figure separates the optional accessories which are external to the jacket from the items which are in the jacket themselves. A plurality of digital video storage devices 42 may also be connected to the jacket for display for exhibition on the display 12. These include a personal computer 44, a CD-ROM 46, or a ROM card 48, and a digitizer 50. The personal computer is connectable through an input to a serial interface 52 then to a data bus 56 which feeds the image decoder 28. The CD-ROM 46, the ROM card 48 and digitizer 50 are connectable to a parallel interface 54 and then to the image decoder 28. The connections to the serial and parallel interface are through a convenient or conventional jacks. A data bus shown schematically 56 brings data from the image memory 26, serial interface 52, and parallel interface 54, as well as instructions from the microcontroller 22.

The output from the image decoder is fed to the video switch 30 which under the control of the microcontroller 22 sends the video signal to the LCD display drivers 32 and then to the liquid crystal display 12.

A power supply 58 provides electric power to the electronics within the jacket as shown schematically by the lead 60. The power supply 58 also provides a back light 62 for the liquid crystal display 12. The power supply 58 may be any convenient or conventional power supply, and preferably is a flat, flexible, lightweight, rechargeable, removable power source located in a pouch 64 in an inner lining of the jacket back. The battery may be a nickel cadmium battery, or any other convenient or conventional battery. The battery is held in place and sealed preferably by velcro, the pouch is covered by a zipper lining.

An audio output 64 is shown connected to microcontroller 22. Audio from the inputs, is fed through the video switch 30 or data bus 56 to microcontroller 22 and then to the output 64. Output typically would be a jack which would then connect to an external earplug. The audio output, however, may include a pair of speakers 66 mounted in the collar of the jacket close to the wearer's ears.

Input devices 68 are contained within the jacket, and may also include jacks for connection to external sources from the jacket. The input devices and the jack 68 are connected to the microcontroller 22. An aspect of the invention is that the images displayed on the liquid crystal display, coming for example from the image memory, are selected by the microcontroller in accordance with environmental conditions as measured by the input devices. For example, the input devices 68 include some or all of the following, the owner's voice print, temperature, humidity, sounds, touch (pressure gauge or excellorometers). Thus the display, would be related to the environment or to the mood or the ambience or setting in which the jacket is worn.

The input device 68 may include operator-operated switches to permit the user to select particular inputs internal or the external digital analog video storage devices.

In an alternative embodiment the video switch 30 has a output connection to an antenna 70. This permits signals from the video switch to be sent on a broadcast frequency allowing other receiving jackets operating on the same frequency to access and display the broadcaster's images. Wherever a transmitter antenna is included, then a transmitter 72 is included between the switch 30 and the antenna 70.

The jacket comes with a built-in global positioning system, G.P.S. 74, which is connected to the power supply 58. This is to provide for security against theft. Information as to the location of the jacket can be used and broadcast to inform law enforcement as well as friends to give information of the position of and the location of the wearer of the jacket.

Figure 4:
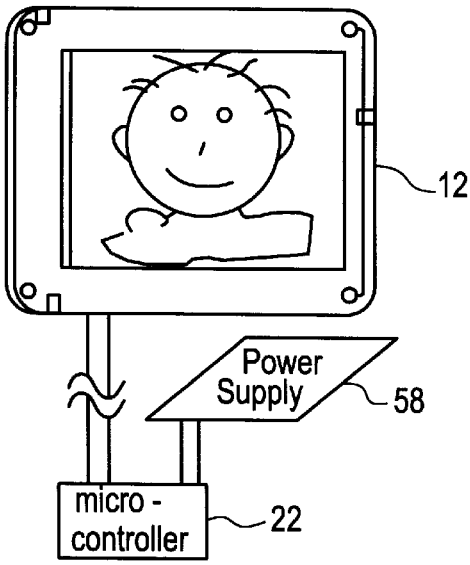
FIG. 4 is a front view of a typical embodiment of the invention before installing in a garment.

FIG. 4 is a schematic drawing of part of the system showing the liquid crystal display 12 and its mounting separate from the jacket schematically connected to the microcontoller 22 and power supply 58. An image of a smiling face is shown on the liquid crystal display 12.

Figure 5:
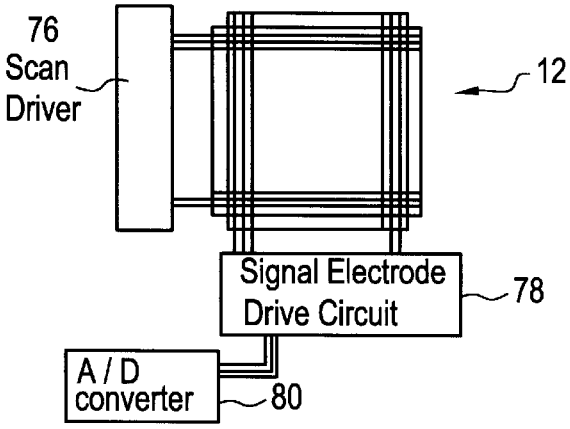
FIG. 5 is a schematic diagram of a typical liquid crystal (LCD) display for use in the invention.

FIG. 5 shows schematically the connection for the display 12 with a scan drive 74 and a signal electron drive circuit 78. An A to D converter 80 may form part of the display driver 32.

Figure 7:
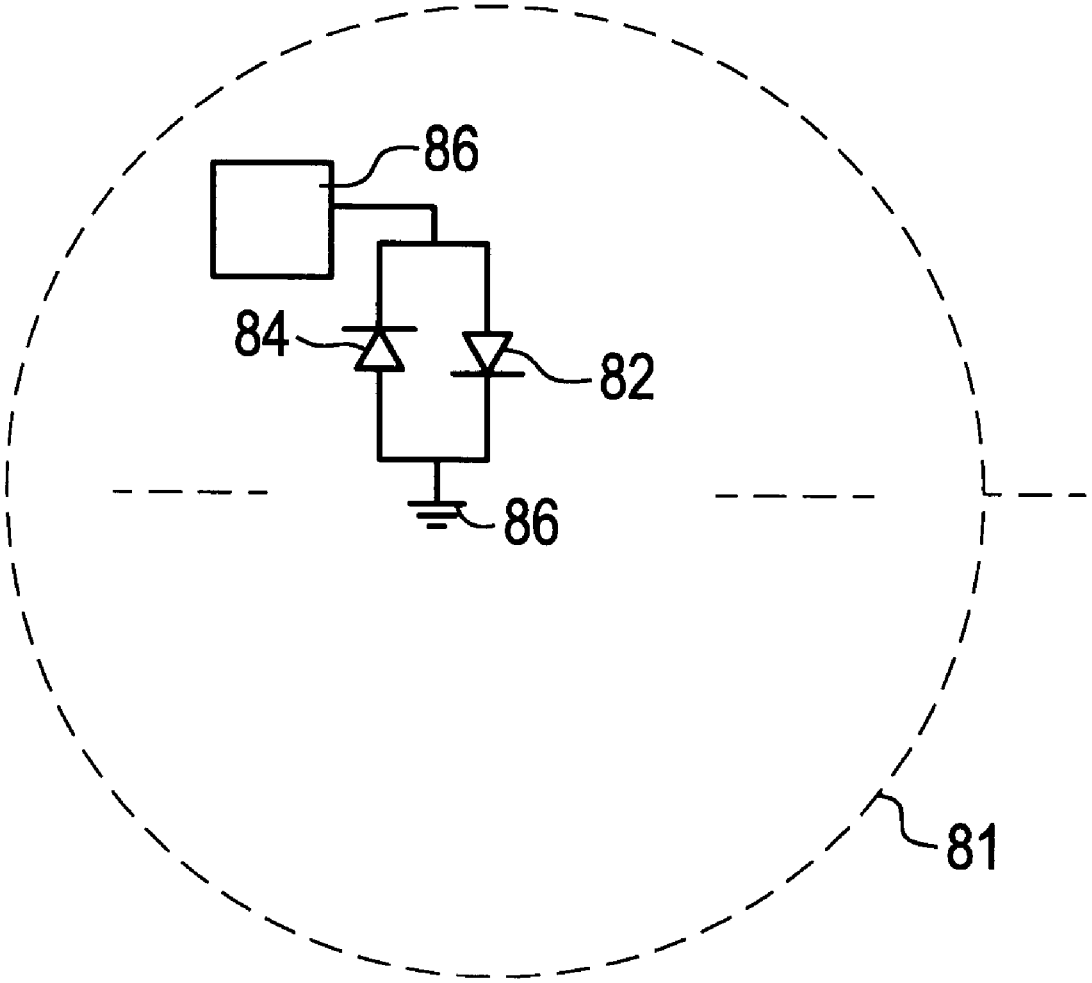
FIG. 7 is a schematic diagram of a circuit.

FIG. 7 shows schematically an aperture 81 in the garment's outer surface through which a light emitting device protrudes. The light emitting device shown here as single tri-color light emitting diodes 82 and 84, however, which define a diode package emitting three different colors. It should be understood, however, that there are a plurality of such light emitting diode packages that are in different apertures throughout the jacket. The tri-color light emitting diode has two different color diodes, 82 and 84, oppositely connected and parallel to each other. An electrical circuit 86 provides current to the diodes. The direction of the current is controllable by the circuit 86 to be either in its first direction wearing one color wherein one diode is activated and one color emitted, or in the reverse direction wherein the second color is emitted from the other diode. Currents in alternating directions activate both diodes and thereby a third color is emitted which is a combination of the first two colors. Thus tri-color light emitting diodes protrude through said apertures in said garment and are shown on the outside.

The microcontroller 22, the image memory 26, and the video switch are typically mounted on a printed circuit board shown schematically, a broken line 88.

The microcontroller 22 has a control circuit with instructions contained in a program in an electronic storage. The microcontroller program may have a random generator to randomly select various images from memory and to scramble or vary the images thereby being able to produce a great number of possible images.

The video images displayed may be either pre-stored in the image memory, or broadcast, or live images, recalled from software programs, local or remotely.

The input devices 68 include in addition to the environmental and sensory inputs, circuitry for interactively initiating video images by giving instructions to the microcontroller. The microcontroller 22 contains programs for operating the system and responding to the various inputs and providing the outputs. It may include an electronic read-write memory or EEPROM memory, which may be reset from time to time. This could either be done from input connection for the input devices and from the keyboard plugged into the input devices 68 or, alternatively, the microcontroller memory to be replaced or retrofitted. If microcontroller 22 program memory is a random access memory, then it would be more apt to be programmed by a keyboard, either locally through parallel or serial ports 54, 52 to an external computer or might be connected through the jack to a central programming unit by telephone lines. The external input devices 68 and external storage devices may include a microphone, thermometer, barometer, miniature video camera, other sensory and external inputs.

Although the embodiment illustrated in the figure is a high fashioned outer jacket, it should be understood that the invention embodies other garments such as but not limited to jumpsuits, windbreakers, sweatshirts and the like, as well as all other articles which may be worn, and which may support the electronics of the invention. The word garment as used herein includes all such articles.

The electronics of the invention on the circuit board, is suitably housed to protect it and then preferably is mounted inside the garment by, for example, a slide lock fastener material bonded to the inside of the jacket to hold the electronics and the liquid crystal display in place. Alternatively, in the place of a locking slide other fasteners might be used.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A system comprising:

(a) a garment;

(b) at least one video image display including a flexible flat panel liquid crystal display disposed on an outside surface of said garment for displaying a moving video image within said at least one video image display, said flexible flat panel liquid crystal display being arranged on said outside surface of said garment such that said flexible flat panel liquid crystal display faces away from said outside surface of said garment and the moving video image is displayed by said liquid crystal display in a manner such that the moving video image faces away from said outside surface of said garment, said moving video image comprising a plurality of different shaped objects each having a plurality of different shades so as to distinguish said different shaped objects from each other;

(c) a storage device for storing at least one video program including data for generating said moving video image;

(d) a video drive connected to said at least one video image display and said storage device for receiving said at least one program and sending signals to said at least one video image display to display said moving video image on said at least one video image display.

2. The system according to claim 1, further comprising a connecting element for mounting said at least one video image display onto the garment.

3. The system according to claim 1, wherein said at least one video program comprises at least one of a digitally recorded program and an analog video program.

4. The system according to claim 1, further comprising a video antenna and a receiver being attached to said garment and connected to said at least one video image display for showing broadcast video programs on said at least one video image display.

5. The system according to claim 4, further comprising an audio output for generating audio output signals to be received by a head phone.

6. The system according to claim 1, further comprising a control mounted in said garment for selectively connecting a program to said driver, a control input connected to said control for operating said control and a program input connected to the control for receiving programs from external sources, selected from the group consisting of tapes, CD, peripheral computers and broadcast frequencies, and cellular telephone.

7. The system according to claim 1, further comprising a global positioning system attached to said garment, whereby information as to a location of the garment can be broadcast.

8. A system comprising:

a garment;

at least one video image display including a flexible flat panel liquid crystal display disposed on a surface of said garment for displaying moving video images within said at least one video image display, said flexible flat panel liquid crystal display being arranged on said outside surface of said garment such that said flexible flat panel liquid crystal display faces away from said outside surface of said garment and the moving video image is displayed by said liquid crystal display in a manner such that the moving video image faces away from said outside surface of said garment, the video image comprising a plurality of different shaped objects each having a plurality of different shades so as to distinguish said different shaped objects from each other;

a source of video signals including a video program containing data for generating said moving video images;

a connector for connecting said video program signals to said at least one video image display for displaying said video images on said at least one video image display so that said video program is shown on said surface of said garment.

9. The system according to claim 8, wherein said garment comprises a jacket.

10. The system according to claim 8, wherein said source includes a plurality of different programs, and said connector selectively connects said program signals to said display.

11. The system according to claim 10, wherein said connector is adapted to be operated manually by an operator or by a stored program.

12. The system according to claim 8, wherein said at least one video image display and said switch are removably mounted on said garment.

13. A system comprising:

a garment;

at least one video image display disposed on a surface of said garment for displaying a moving video image within said at least one video image display, said flexible flat panel liquid crystal display being arranged on said outside surface of said garment such that said flexible flat panel liquid crystal display faces away from said outside surface of said garment and the moving video image is displayed by said liquid crystal display in a manner such that the moving video image faces away from said outside surface of said garment, said the moving video image comprising a plurality of different shaped objects each having a plurality of different shades so as to distinguish said different shaped objects from each other;

a source of video signals including a video program containing data for generating said moving video image;

a connector for connecting said video program signals to said at least one video image display for displaying said moving video image on said at least one video image display so that said video program is shown on said surface of said garment;

wherein said connector has an input for operation thereof; said system further comprising a transducer mounted on said garment said transducer having an input for sensing an ambient condition, and an output connected to said input for operating a switch and said programs displayed on said garment in accordance with said sensed ambient conditions.

14. The system according to claim 13, wherein said ambient conditions to be sensed are selected from the group consisting of humidity, heat, sound, and touch.

15. A system adapted to be installed on a garment comprising:

(a) a garment, (b) at least one video image display including a flexible flat panel display disposed on an outside surface of said garment, and forming a part of said garment, said flexible flat panel liquid crystal display being arranged on said outside surface of said garment such that said flexible flat panel liquid crystal display faces away from said outside surface of said garment and the moving video image is displayed by said liquid crystal display in a manner such that the moving video image faces away from said outside surface of said garment, said at least one video image display being adapted to display a moving video image within said at least one video image display, the moving video image comprising a plurality of different shaped objects each having a plurality of different shades so as to distinguish said different shaped objects from each other;

(c) a memory connected to said at least one video image display and storing a plurality of video programs;

(d) a video driver connected to said at least one video image display for sending signals to said at least one video image display in accordance with one of said video programs stored in said memory;

(e) a control unit mounted in said garment for selectively connecting said programs to said driver and thus changing said programs to be shown on said at least one video image display, and (f) an input to said control unit for operating said control unit.

* * * * *